United States Patent [19]

Yoshida et al.

[11] 4,054,722

[45] Oct. 18, 1977

[54] ACYLOXY SUBSTITUTED ACRYLATE TIMING LAYERS FOR COLOR DIFFUSION TRANSFER

[75] Inventors: Takashi Yoshida; Shinji Sakaguchi, both of Minami-ashigara, Japan

[73] Assignee: Fuji Photo Film Co., Ltd., Minami-ashigara, Japan

[21] Appl. No.: 699,138

[22] Filed: June 23, 1976

[30] Foreign Application Priority Data

June 23, 1975 Japan ..... 50-77946

[51] Int. Cl.[2] ..... G03C 7/00; G03C 1/40; G03C 5/54; B44N 1/09

[52] U.S. Cl. ..... 428/522; 96/3; 96/29 D; 96/77; 96/119 R

[58] Field of Search ..... 96/3, 29 D, 77, 119 R; 428/520, 522

[56] References Cited

U.S. PATENT DOCUMENTS 3,847,165 11/1974 Yoshida et al. ..... 96/77

OTHER PUBLICATIONS

"Neutralizing Mat'l . . . elements", *Research Disclosure* No. 12331, 7/1974, pp. 22–24.

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

A material for a color diffusion transfer photographic process, which possesses neutralizing means comprising the combination of a layer containing a polymer having a repeating unit represented by the following general formula (I):

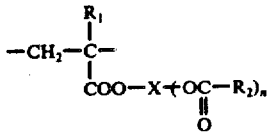

wherein $R_1$ represents a hydrogen atom or a methyl group, $R_2$ represents a hydrogen atom, an aliphatic hydrocarbon residue having 1 to 6 carbon atoms or an aryl group, and X represents an $n+1$ valent aliphatic hydrocarbon residue having 2 to 8 carbon atoms or an $n+1$ valent residue of the formula $-(A-O)_m-A$, wherein A represents an aliphatic hydrocarbon residue having 2 to 4 carbon atoms, and $m$ and $n$ each represents an integer of 1 to 5, and an acidic polymer layer.

9 Claims, No Drawings

ACYLOXY SUBSTITUTED ACRYLATE TIMING LAYERS FOR COLOR DIFFUSION TRANSFER

BACKGROUND OF THE INVENTION

1. Field of the Invention

The present invention relates to a color diffusion transfer photographic process, more particularly, to a photographic material adapted for obtaining stable transferred color images by a color diffusion photographic process.

2. Description of the Prior Art

In general, a color diffusion transfer photographic light-sensitive material (hereinafter referred to as "DTR color light-sensitive material") comprises (1) a light-sensitive element having three units (corresponding to the three primary colors) each of which contains a dye-providing material capable of providing a diffusible dye, and a light-sensitive silver halide emulsion layer in combination; (2) a processing element containing a processing solution composition (alkaline aqueous solution or aqueous dispersion) capable of developing exposed light-sensitive elements and permitting dyes to diffuse; and (3) an image-receiving element containing an image-receiving layer capable of image-wise fixing diffused dyes.

One merit of DTR color light-sensitive materials is that color print photographic picture can be obtained immediately after photography, and, in order to maximally utilize this benefit, an "instant photographic processing" mechanism, in which stabilizing processings such as washing of images or fixing images after development processing are not involved, is incorporated in a light-sensitive material, which is quite different from conventional photographic processes.

Since washing or fixing processing are not per se conducted as separate steps in diffusion transfer photographic processing, it is necessary to provide in a light-sensitive material some mechanism to automatically stabilize images in order to obtain stable images.

As one process for stabilizing images, it is known to provide a neutralizing mechanism in a light-sensitive material, that is, to remove those factors which destroy or change formed images by absorbing, after development processing, alkali ingredients and salt-forming reagents in a processing solution.

U.S. Pat. Nos. 3,362,819 and 3,575,701 suggest some techniques for this purpose, which fundamentally comprise providing on a support an acidic polymer layer and an inert polymer layer (hereinafter referred to as a "timing layer"). The acidic polymer layer functions to absorb alkali ingredients and salt-forming reagents in the processing solution, whereas the timing layer functions to delay the initiation of the function of the acidic polymer (layer) in order to prevent too early an initiation of the function of the acidic polymer (layer), which would result in insufficient developing.

As the inert polymer (timing layer), the aforesaid U.S. Patents describe polymers such as polyvinyl alcohol, partially acetallized products thereof, gelatin, polyvinylamide graft copolymers, and the like. The neutralizing mechanism involving these polymers comprises transmitting almost constant amounts of water, alkali ingredients and salt-forming reagents during development, and, as a result, possesses the characteristic that pH is comparatively rapidly decreased in an image-receiving layer and a light-sensitive layer.

Such a rapid pH decrease fails to maintain the pH at a level necessary for development, and, as a result, the particularly desired rapid developing velocity cannot be obtained. On the other hand, when pH decreases comparatively slowly, it takes a comparatively long period of time for the pH value to reach a region where images are stable (pH 5 to 7, preferably 6 to 7). Thus, there is the defect of probable staining (or spoiled image stability).

SUMMARY OF THE INVENTION

As a result of various investigations, the inventors have found that a certain polymer capable of adjusting changes in pH with the passage of time in an image-receiving layer and in a light-sensitive layer during development serves to provide high image density, rapid developing velocity and high image stability.

It is therefore one object of the present invention to provide a photographic material having a neutralizing mechanism for use in a color diffusion transfer photographic process, which provides dye images having improved image density.

Another object of the present invention is to provide a color diffusion transfer photographic material showing an improved developing velocity.

A further object of the present invention is to provide a color diffusion transfer photographic material capable of providing images having excellent storage stability.

The above-described objects can be effectively attained by using a timing layer containing as a major component a polymer having the repeating unit represented by the following general formula (I) and an acidic polymer layer in combination. General formula (I):

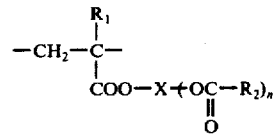

In the above general formula, $R_1$ represents a hydrogen atom or a methyl group, $R_2$ represents a hydrogen atom, an aliphatic hydrocarbon residue having 1 to 6 carbon atoms or an aryl group, most preferably a monocyclic aryl group such as a phenyl group, X represents an n+1 valent residue of an aliphatic hydrocarbon having 2 to 8 (preferably 2 to 6, particularly preferably 2 to 5) carbon atoms or an n+1 valent residue of an $\text{-}(A\text{-}O)_m A$ group (wherein A represents an aliphatic hydrocarbon residue having 2 to 4 carbon atoms), *m* and *n* each represents an integer of 1 to 5, preferably 1 to 3, and particularly preferably 1 or 2.

DETAILED DESCRIPTION OF THE INVENTION

In timing layers in accordance with the present invention, the polymer of the present invention is present therein in an amount ranging from about 30 to 100% by weight, preferably from 70 to 100% by weight, based on the total weight of the polymer(s) comprising the timing layer. Where another polymer(s) is/are used in combination therewith, other polymers which comprise the timing layer can be present in an amount of up to about 70% by weight, more preferably in an amount of 1 to 30% by weight, when used. Particularly preferred of such other polymers are homopolymers, copolymers or graft copolymers of mono (meth)-acrylates of polyhydric alcohols as are as disclosed in U.S. Pat. No. 3,847,615.

When the timing layer of the present invention is used, changes in pH with the passage of time are such that the pH value is at a level as high as about 12 to 13 from the initiation of development to the sufficient completion of development, and, thereafter, rapidly decreases to around neutral. The period at which the pH value rapidly decreases is about 10 to about 30 minutes, preferably 15 to 20 minutes, after the initiation of development. With delamination type photographic materials, this period takes about 1 to about 3 minutes, preferably 1 to 2 minutes, after initiation of the development.

This is attributable to the fact that the initiation of hydrolysis, when in contact with an alkali solution, of polymers for the timing layer to be used in the present invention is slow, i.e., there is an induction period, and, once the hydrolysis reaction starts, it proceeds quite rapidly. Therefore, when a processing solution is spread on a light-sensitive layer after exposure thereof, the timing layer does not undergo hydrolysis for a definite period of time, during which time a light-sensitive layer and an image-receiving layer maintain a high pH value, and development and dye transfer are sufficiently effected. After a definite period of time, the timing layer is rapidly hydrolyzed to permit the transmission of water, alkalis, salt-forming reagents, and the like. Thus, chemical substances harmful to the storage of transferred images are almost completely absorbed by an acidic polymer layer, and the pH of the image-receiving layer and the light-sensitive layer decrease to around neutral.

The timing layer is hydrolyzed as shown by the following reaction formula

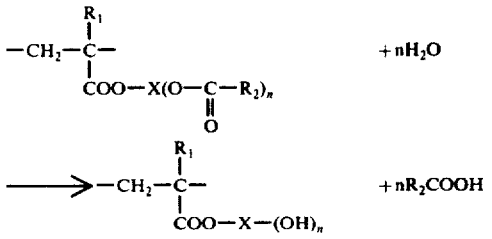

wherein all moieties are as earlier defined.

It is considered that the neutralizing mechanism of the present invention increases the developing and transferring velocity in the color diffusion transfer photographic process and provides images having good stability and high density based on the reasons described above. In order to obtain these good effects, a desirable change in pH (in the light-sensitive layer and the image-receiving layer) is such that the pH value is at a level as high as about 12 to about 13 until about 10 minutes after development, and, thereafter, rapidly decreases to reach around neutrality (about pH 7).

The polymers having the repeating unit represented by general formula (I) may be homopolymers or copolymers. They can be obtained by the homopolymerization of a monomer represented by the following general formula (IA):

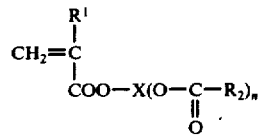

wherein $R_1$, $R_2$, X and $n$ are the same as defined in general formula (I), or by the copolymerization thereof with an unsaturated compound which can be addition polymerized with the monomer.

As specific examples of monomers represented by general formula (IA), there can be illustrated, for example, 2-acetoxyethyl methacrylate, 3-acetoxypropyl methacrylate, 2-acetoxypropyl methacrylate, 2,3-diacetoxypropyl methacrylate, 4-acetoxybutyl methacrylate, 5-acetoxypentyl methacrylate, 2,2-dimethyl-3-acetoxypropyl methacrylate, diethylene glycol acetate methacrylate, triethylene glycol acetate methacrylate, dipropylene glycol acetate methacrylate, glycerol diacetate methacrylate, trimethylolethane diacetate methacrylate, trimethylolpropane monoacetate monomethacrylate, pentaerythritol triacetate methacrylate, 2-acetoxyethyl acrylate, 3-acetoxypropyl acrylate, 2-acetoxypropyl acrylate, 2,3-diacetoxypropyl acrylate, 4-acetoxybutyl acrylate, 5-acetoxypentyl acrylate, 2,2-dimethyl-3-acetoxypropyl acrylate, diethyleneglycol acetate acrylate, triethylene glycol acetate acrylate, dipropylene glycol acetate acrylate, glycerol monoacetate monoacrylate, trimethylolethane acetate acrylate, trimethylol propane monoacetate monoacrylate, pentaerythritol triacetate acrylate, 2-chloroacetoxyethyl acrylate, 3-chloroacetoxybutyl acrylate, 2-trifluoroacetoxyethyl acrylate 2-benzoyloxyethyl acrylate, 2-trimethylacetoxyethyl acrylate, 2-phenylacetoxyethyl acrylate, 2-propionoyloxyethyl acrylate, ethylene glycol formate acrylate, 2-caproyloxyethyl acrylate, 2-dichloroacetoxypropyl acrylate, 1-bromo-2-acetoxyethyl acrylate, 1,1-dichloro-2-acetoxyethyl acrylate, 2-acetoxy-3-chloropropyl acrylate, 2-cyanoacetoxyethyl methacrylate, 3-chloroacetoxybutyl methacrylate, 2-dichlorobromoacetoxyethyl methacrylate, 2-butyroyloxyethyl methacrylate, 2-trimethylacetoxyethyl methacrylate, 2-phenylacetoxyethyl methacrylate, 2-propionoyloxyethyl methacrylate, 2-benzoyloxyethyl methacrylate, ethylene glycol chloroformate methacrylate, 2-caproyloxyethyl methacrylate, 2-chloroacetoxypropyl methacrylate, 1-bromo-2-acetoxyethyl meth-acrylate, 1,1-dichloro-2-acetoxyethyl methacrylate, 2-acetoxy-3-chloropropyl methacrylate, etc. Of these, polymers prepared by using, wholly or partly, 2-acetoxyethyl methacrylate, 2-acetoxyethyl acrylate or 2-acetoxypropyl acrylate as a monomer can be recommended as a polymer for the timing layer of the present invention.

As is described above, the aliphatic hydrocarbon residue in the general formula (I) includes those substituted by a halogen atom (e.g., chlorine, fluorine, bromine, etc.), a cyano group, a hydroxy group, an aryl group (e.g., phenyl, etc.), an alkoxy group (e.g., methoxy, ethoxy, etc.), or the like, as earlier defined.

As the addition-polymerizable unsaturated compounds used as a comonomer to form a copolymer with the monomer represented by the general formula (IA), there can be illustrated, for example, acrylic acids, acrylamides, methacrylic acids, methacrylamides, allyl compounds, vinyl ethers, vinyl esters, vinyl heterocyclic compounds, styrenes, maleic acids, fumaric acids, itaconic acids, olefins, crotonic acids, etc.

Specific examples of these compounds include acrylic acids such as acrylic acid and acrylates (e.g., methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octyl acrylate, tertoctyl acrylate, 2-phenoxyethyl acrylate, 2-chloroethyl acrylate, 2-bromoethyl acrylate, 4-chlorobutyl acrylate, cyanoethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, etc.); methacrylic acids such as methacrylic acid and methacrylates (e.g., methyl methacrylate, ethyl methacrylate, n-propyl methacrylate, isopropyl methacrylate, n-butyl methacrylate, isobutyl methacrylate, sec-butyl methacrylate, amyl methacrylate, hexyl methacrylate, cyclohexyl methacrylate, benzyl methacrylate, cyanoacetoxyethyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, etc.); acrylamides such as acrylamide and N-substituted acrylamides (e.g., methylacrylamide, ethylacrylamide, propylacrylamide, isopropylacrylamide, butylacrylamide, tert-butylacrylamide, heptylacrylamide, tertoctylacrylamide, cyclohexylacrylamide, benzylacrylamide, hydroxymethylacrylamide, methoxyethylacrylamide, dimethylaminoethyl-acrylamide, hydroxyethylacrylamide, phenylacrylamide, hydroxyphenylacrylamide, tolylacrylamide, naphthylacrylamide, dimethylacrylamide, diethylacrylamide, dibutylacrylamide, diisobutylacrylamide, N-(1-1-dimethyl-3-oxobutyl)acrylamide, methylbenzylacrylamide, benzyloxyethylacrylamide, β-cyanoethylacrylamide, acryloylmorpholine, N-methyl-N-acryloylpiperadine, N-acryloylpiperidine, acryloylglycine, N-(1,1-dimethyl-3-hydroxybutyl)-acrylamide, N-β-morpholinoethylacrylamide, N-acryloylhexamethyleneimine, N-hydroxyethyl-N-methylacrylamide, N-2-acetamidoethyl-N-acetylacrylamide, acrylhydrazine, etc.); methacrylamides such as methacrylamide and N-substituted methacrylamide (e.g., methylmethacrylamide, tert-butylmethacrylamide, tert-octylmethacrylamide, benzylmethacrylamide, cyclohexylmethacrylamide, phenylmethacrylamide, dimethylmethacrylamide, diethylmethacrylamide, dipropylmethacrylamide, hydroxyethyl-N-methylmethacrylamide, N-methyl-N-phenylmethacrylamide, N-ethyl-N-phenylmethacrylamide, methacrylhydrazine, etc.); allyl compounds such as allyl esters (e.g., allyl acetate, allyl caproate, allyl caprylate, allyl laurate, allyl palmitate, allyl stearate, allyl benzoate, allyl acetoacetate, allyl lactate, etc.), allyloxyethanol, allyl butyl ether, allyl phenyl ether, etc,; vinyl ethers (e.g., methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethylene glycol vinyl ether, dimethylaminoethyl vinyl ether, diethylaminoethyl vinyl ether, butylaminoethyl vinyl ether, benzyl vinyl ether, tetrahydrofurfuryl vinyl ether, vinyl phenyl ether, vinyl tolyl ether, vinyl chlorophenyl ether, vinyl 2,4-dichlorophenyl ether, vinyl naphthyl ether, vinyl anthranyl ether, etc.); vinyl esters (e.g., vinyl formate, vinyl acetate, vinyl propionate, vinyl butyrate, vinyl isobutyrate, vinyl dimethylpropionate, vinyl ethylbutyrate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl β-phenylbutyrate, vinyl cyclohexylcarboxylate, vinyl benzoate, vinyl salicylate, vinyl chlorobenzoate, vinyl tetrachlorobenzoate, vinyl naphthoate, etc.); vinyl heterocyclic compounds (e.g., N-vinyloxazolidone, vinylpyridine, vinylpicoline, N-vinylimidazole, N-vinylpyrrolidone, N-vinylcarbazole, vinylthiophene, N-vinylethylacetamide, etc.); styrenes (e.g., styrene, methylstyrene, dimethylstyrene, trimethylstryrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinylbenzoic acid, vinylbenzoic acid methyl ester, etc.); crotonic acids such as crotonic acid, crotonic acid amide and crotonic acid esters (e.g., butyl crotonate, hexyl crotonate, glycerol monocrotonate, etc.); vinyl ketones (e.g., methyl vinyl ketone, phenyl vinyl ketone, methoxyethyl vinyl ketone, etc.); olefins (e.g., dicyclopentadiene, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,6,6-trimethyl-1-heptene, 1-dodecene, 1-octadecene, etc.); itaconic acids (e.g., itaconic acid, itaconic anhydride, methyl itaconate, ethyl itaconate, diethyl itaconate, dibutyl itaconate, etc.); sorbic acid; cinnamic acid; methyl sorbate; citraconic acid; chloroacrylic acid; mesaconic acid; maleic acids (e.g., maleic acid, maleic anhydride, ethyl maleate, butyl maleate, dibutyl maleate, octyl maleate, etc.); fumaric acids (e.g., ethyl fumarate, hexyl fumarate, dibutyl fumarate, octyl fumarate, etc.); methacrylic acid; halogenated olefins (e.g., vinyl chloride, vinylidene chloride, isoprene chloride, etc.); unsaturated nitriles (e.g., acrylonitrile, methacrylonitrile, etc.). These can be used alone or in combination as occasion calls. Of these monomers, acrylic acid esters, methacrylic acid esters, vinyl esters, acrylamides, methacrylamides, vinyl heterocyclic compounds, and the like are preferred from the viewpoints of solubility, transparency, hydrophilicity, close adherence to the adjacent layer, coating aptitude, and development processability of the resulting polymer.

The composition ratio of the copolymer having the repeating unit represented by the general formula (I) is not particularly limited. However, the proportion of the ingredient represented by general formula (I) is preferably from about 10 to about 98 mol%, particularly preferably from to to 95 mol% and most preferably from 70 to 90 mol%. In those instances where one has a homopolymer, of course, the proportion of the ingredient represented by General Formula (I) is 100 mol%.

The synthesis of the homopolymers or copolymers having repeating units represented by general formula (I) is conveniently conducted by reference to the processes described in British Pat. Nos. 961,395, 1,211,039, Japanese Patent Publication No. 29195/72, Japanese Patent Applications Nos. 7174/72, 23466/72, 59743/72, 31355/73, U.S. Pat. Nos. 3,227,672; 3,290,417; 3,262,919; 3,245,932; 2,681,897; 3,230,275; John C. Petropoulos et al; *Official Digest*, 33, 719–736 (1961), *Synthetic High Polymers*, edited by Shunsuke Murahashi et al, 1, pp. 246–290, 31–108, etc. Needless to say, factors such as the polymerization initiator, concentration polymerization temperature, reaction time, etc. can be changed widely and easily.

For example, polymerization is generally effected at 20° to 180° C, preferably 40° to 120° C. Usually, polymerization is conducted by using a free radical polymerization initiator in an amount of 0.05 to 5% by weight based on the monomer(s) to be polymerized. As the polymerization initiator, there can illustrated azobis compounds, peroxides, hydroperoxides, redox catalysts, etc., more particularly, potassium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobisisobutyronitrile, etc.

The molecular weight of the polymers used in the present invention is usually about 2,000 or more, preferably 100,000 to 1,000,000. However, these values are not critical for obtaining the effects of the present invention.

Typical specific examples of polymers having the repeating unit represented by general formula (I) used in the present invention are as follows:

1. Poly(2-acetoxypropyl acrylate)
2. Poly(2-acetoxyethyl methacrylate)
3. Poly(2-acetoxyethyl acrylate)
4. Poly(diethylene glycol acetate acrylate)
5. Poly(2-trifluoroacetoxyethyl acrylate)
6. Poly(2-benzoyloxyethyl methacrylate)
7. Poly(2-propionoyloxyethyl methacrylate)
8. 2-Hydroxyethyl acrylate/2-acetoxyethyl acrylate copolymer (molar ratio: 20 : 80)
9. 2-Hydroxyethyl acrylate/2-trimethylacetoxyethyl acrylate copolymer (molar ratio = 30:70)
10. 2-Hydroxyethyl acrylate/2-acetoxyethyl methacrylate copolymer (molar ratio = 10:90)
11. 2-Hydroxyethyl acrylate/2-acetoxyethyl methacrylate copolymer (molar ratio = 5:95)
12. 2-Hydroxyethyl acrylate/2-acetoxypropyl acrylate copolymer (molar ratio = 10:90)
13. 2-Hydroxyethyl methracrylate/2-acetoxyethyl acrylate copolymer (molar ratio = 20:80)
14. 2-Acetoxyethyl acrylate/acrylamide copolymer (molar ratio = 90:10)
15. 2-Acetoxyethyl acrylate/vinyl alcohol copolymer (molar ratio = 80:20)
16. 2-Acetoxyethyl methacrylate/N-vinylpyrrolidone copolymer (molar ratio = 70:30)
17. 2-Acetoxyethyl methacrylate/2-hydroxypropyl methacrylate copolymer (molar ratio = 60:40)
18. 2-Acetoxypropyl methacrylate/N,N-dimethylacrylamide copolymer (molar ratio = 75:25)
19. 2-Acetoxyethyl methacrylate/N-tert-butyl acrylamide copolymer (molar ratio = 60:40)
20. 2-Acetoxyethyl methacrylate/acryloylmorpholine copolymer (molar ratio = 70:30)
21. 2-Acetoxyethyl acrylate/N-(1,1-dimethyl-3-hydroxybutyl)-acrylamide copolymer (molar ratio = 75:25)
22. 2-Acetoxyethyl methacrylate/N-(1,1-dimethyl-3-oxobutyl)-acrylamide copolymer (molar ratio = 80:20)
23. 2-Acetoxyethyl acrylate/N,N-dibutylacrylamide copolymer (molar ratio = 60:40)
24. 2-Acetoxyethyl methacrylate/N,N-diethyl methacrylamide copolymer (molar ratio = 60:40)
25. 2-Acetoxyethyl acrylate/vinyl acetate copolymer (molar ratio = 70:30)
26. 2-Acetoxyethyl methacrylate/acryloylpiperidine copolymer (molar ratio = 87:13)
27. 2-Acetoxypropyl methacrylate/N-vinyl-2-methylimidazole copolymer (molar ratio = 92:8)
28. 2-Acetoxyethyl methacrylate/1-vinyl-3,5-dimethyl-1,2,4-triazole copolymer (molar ratio = 95:5)
29. 2-Acetoxyethyl methacrylate/N-methylpiperadinoacrylamide copolymer (molar ratio = 78:22)
30. 2-Acetoxyethyl methacrylate/N,N-dimethyl methacrylamide copolymer (molar ratio = 72:28)
31. 2-Acetoxypropyl methacrylate/N-(1,1-dimethyl-3-hydroxybutyl)acrylamide copolymer (molar ratio = 60:40)
32. 2-Acetoxyethyl methacrylate/methyl vinyl ether copolymer (molar ratio = 60:40)
33. 2-Acetoxypropyl methacrylate/acryloylmorpholine copolymer (molar ratio = 83:17)
34. 2-Chloroacetoxypropyl acrylate/vinyl acetate copolymer (molar ratio = 60:40)
35. 2-Benzoyloxypropyl acrylate/vinyl butyl ether copolymer (molar ratio = 60:40)
36. Diethylene glycol formate methacrylate/N-vinylpyrrolidone copolymer (molar ratio = 90:10)
37. Triethylene glycol acetate methacrylate/p-hydroxystyrene copolymer (molar ratio = 60:40)
38. Trimethylolpropane monoacetate monoacrylate/-sodium acrylate copolymer (molar ratio = 80:20)
39. Pentaerythritol triacetate acrylate/2-hydroxyethyl methacrylate copolymer (molar ratio = 80:20)
40. 2-Acetoxyethyl acrylate/2-acetoxypropyl methacrylate/N-vinylpyrrolidone copolymer (molar ratio = 40:35:25)
41. 2-Acetoxyethyl acrylate/N-(1,1-dimethyl-3-oxobutyl)-acrylamide/2-hydroxyethyl acrylate copolymer (molar ratio = 80:10:10)
42. 2-Acetoxypropyl acrylate/N,N-diethylacrylamide/vinyl acetate copolymer (molar ratio = 70:10:20)
43. 2-Chloroacetoxyethyl acrylate/3-trimethylacetoxybutyl acrylate/2-hydroxyethyl acrylate copolymer (molar ratio = 40:40:20)
44. 2-Acetoxyethyl methacrylate/2-butyroyloxyethyl acrylate/2,3-dihydroxypropyl acrylate copolymer (molar ratio = 70:20:10)
45. 2-Trifluoroacetoxypropyl acrylate/3-acetoxybutyl acrylate/N,N-dimethylacrylamide copolymer (molar ratio = 20:60:20)
46. 3-Phenylacetoxybutyl acrylate/2-acetoxyethyl acrylate copolymer (molar ratio = 20:80)
47. 2-Acetoxypropyl acrylate/2-benzoyloxyethyl methacrylate/2-hydroxyethyl acrylate copolymer (molar ratio =75:5:20)

The above-described polymer materials to be used for the timing layer in the present invention can be coated on an acidic polymer layer by dissolving them in a solvent properly selected from among organic solvents such as alcohols (e.g., methanol, ethanol, isopropanol, etc.); ketones (e.g., acetone, methyl ethyl ketone, diethyl ketone, cyclohexanone, etc.); esters (e.g., methyl acetate, ethyl acetate, isopropyl acetate, n-butyl acetate, etc.); aromatic hydrocarbons (e.g., benzene, toluene, xylene, etc.); mixtures of these organic solvents; mixtures of the organic solvent and water; and the like.

The necessary film thickness upon coating must be selected according to the purpose, but usually it is in the range of from about 0.5 to about 30 μ, preferably from about 0.5 to 10 μ, particularly preferably from about 0.7 to 2 μ, though such is not limited thereto.

The polymer material used for the timing layer in the present invention may form a film either independently or together with other additives such as a plasticizer (e.g., trialkyl phosphate, dibutyl phthalate, polyethylene glycol, etc.), a cross-linking agent (e.g., formaldehyde, trimethylol melamine, dimethylol urea, glyoxal, glutaraldehyde, etc.), polymers prepared from acrylic acid esters, methacrylic acid esters, cellulose, etc., or the like, depending upon the end use.

Also, an interlayer may be provided intermediate the timing layer and the acidic polymer layer for improving close adherence or the like. Such an interlayer may also be provided on the timing layer upon coating a light-sensitive layer or an image-receiving layer. Preferred interlayers are formed of polymers which enable one to control the permeability of an aqueous alkaline processing solution depending upon the temperature of the system, for example, a polymer such as a vinylidene chloride/acrylonitrile copolymer, or polymers such as polyvinyl alcohol which improve adherence. The thickness of the interlayer is not overly important, and can be freely varied by one skilled in the art to achieve the desired effect.

For the acidic polymer layer to be used in the present invention, the use of film-forming acidic polymers is preferred, and any of such acidic polymers can be employed.

The acidic polymers preferably possess a molecular weight of about 10,000 to about 100,000. For example, there may be used a monobutyl ester of maleic anhydride/ethylene (1:1; hereafter molar) copolymer, a monobutyl ester of maleic anhydride/methyl vinyl ether 1:1 copolymer, a monoethyl ester, monopropyl ester, monopentyl ester or monohexyl ester of maleic anhydride/ethylene 1:1 copolymer, a monoethyl ester, monopropyl ester, monopentyl ester or monohexyl ester of maleic anhydride/methyl vinyl ether 1:1 copolymer, polyacrylic acid, polymethacrylic acid, acrylic acid/methacrylic acid copolymers (with various copolymerization ratios), copolymers of acrylic or methacrylic acid and other vinyl monomers (e.g., acrylic acid ester, methacrylic acid ester, vinyl ether, etc.) with various copolymerization ratios, i.e., copolymers containing at least 30 mol%, preferably 50 to 90 mol%, acrylic or methacrylic acid, or the like. Of these, the use of polyacrylic acid is recommendable. Such acidic polymers are coated on a support by dissolving them in alcohols (e.g., methanol, ethanol, propanol, butanol, etc.), ketones (e.g., acetone, methyl ethyl ketone, diethyl ketone, cyclohexanone, etc.), esters (e.g., methyl acetate, ethyl acetate, isopropyl acetate, butyl acetate, etc.), mixtures thereof, or the like.

The thickness of the acidic polymer cannot unequivocally be set since it varies depending upon the composition and amount of processing composition used, and upon the material of the acidic layer to be used. However, a thickness of about 5 to about 30 μ is generally suitable.

As the stratum structure of the acidic polymer layer and the timing layer coated thereon used in the present invention in a DTR color light-sensitive material, there are, for example, the following embodiments.

1. An embodiment wherein an acidic polymer layer, a timing layer and an image-receiving layer are coated, in this order, on a support and, on the other hand, a light-sensitive layer is coated on another support, with these two being constituted so that a processing solution can be spread between the light-sensitive layer and the image-receiving layer.

2. An embodiment wherein an image-receiving layer is coated on a support and, on the other hand, an acidic polymer layer, a timing layer and a light-sensitive layer are coated, in this order, on a support, with these two being constituted so that a processing solution can be spread between the light-sensitive layer and the image-receiving layer.

3. An embodiment wherein an acidic polymer layer, a timing layer, an image-receiving layer, a white reflecting layer and a light-sensitive layer are coated, in this order, on a support, with such a construction that a processing solution can be spread on the surface of the light-sensitive layer (opposite side to the white reflecting layer).

4. An embodiment wherein an acidic polymer layer and a timing layer are coated, in this order, on a support and, on the other hand, an image-receiving layer, a white reflecting layer and a light-sensitive layer are coated on another support in this order, with these two being constituted so that a processing solution can be spread on the surface of the light-sensitive layer (opposite side to the white reflecting layer).

(All of the above-enumerated layers are only typical ones, and layers suitable for supplementing the functions of those layers may be coated in addition thereto.)

In a light-sensitive element, the following can be used as a dye image-providing material to be used in combination with a silver halide emulsion. Of these, the use of diffusible dye-releasing couplers to be described hereinafter is particularly recommendable.

Particularly preferred white reflecting layers and other subsidiary layers as are generally discussed above as can be utilized in the present invention are disclosed in U.S. Pat. Nos. 3,594,164, 3,689,262 and 3,701,656.

a. Dye developers

As is described in U.S. Pat. No. 2,983,606, this is a compound which possesses both a dye structure moiety and a silver halide developing group in one molecule. When this dye developer and an alkali are applied to an image-wise exposed silver halide emulsion, reduction of silver halide and oxidation of the color developer concur. The oxidized dye developer possesses less solubility and less diffusibility in a processing composition as compared with the reduced form of the original dye developer and is therefore fixed in the vicinity of the reduced silver halide. In a preferred embodiment, the dye developer possesses at least one "solubilizing" group which makes the dye developer substantially insoluble in an acidic or neutral aqueous medium, but, in the alkaline processing compositions, makes it soluble and diffusible. Such a dye developer can be incorporated in a light-sensitive element, in particular, in a silver halide emulsion layer or in an adjacent layer. When diffusion transfer is conducted from a light-sensitive element having two or more light-sensitive units, in which a silver halide emulsion and a dye developer having an absorption characteristic corresponding to the light-sensitive wave-length region of the emulsion are combined, to a single image-receiving element, multi-color positive images can be obtained through one development processing. The light absorption of the dye developer is advantageously that which enables the reproduction of colors based on subtractive color photography, i.e., that which provides yellow, magenta or cyan. The dye structure moieties which provide such absorption can be derived from azo dyes, anthraquinone dyes, phthalocyanine dyes, nitro dyes, quinoline dyes, azomethine dyes, indamine dyes, indoaniline dyes, indophenol dyes, azine dyes, etc.

On the other hand, a silver halide-developing group represents a group capable of developing light-exposed silver halide, and preferably represents a group which, as a result of oxidation, loses its hydrophilicity. In general, a benzenoid developing group, i.e., an aromatic developing group which, upon being oxidized, forms a quinoid structure is suitable. A preferred developing group is a hydroquinonyl group. As other suitable developing groups, there can be illustrated an o-dihydroxyphenyl group, an o-and p-amino-substituted hydroxyphenyl group, and the like. In the preferred dye developers, the dye structure moiety and the developing group are separated from each other by a saturated aliphatic group such as an ethylene group, which prevents electron conjugation. In particular, a 2-hydroquinonylethyl group and a 2-hydroquinonylpropyl group are useful. The dye structure moiety and the developing group may be connected to each other through a coordinate bond as described in U.S. Pat. Nos. 3,551,406; 3,563,739; 3,597,200 and 3,674,478, as well as a covalent bond. Furthermore, for some for end use purposes and with some diffusion transfer color photographic materials, it is advantageous to reduce the dye structure moiety to thereby temporarily convert it to a colorless leuco form as is described in U.S. Pat. No. 3,320,063, or to acylate the hydroxyl group or amino group of the auxochrome to thereby temporarily shift the absorption to the shorter wave-length side as is described in U.S. Pat. Nos. 3,230,085 and 3,307,947. Dye developers having a dye structure moiety bearing a hydroxy group in the ortho position to the azo bond are useful in that they are excellent in absorption characteristics and in stability of color images as described in U.S. Pat. No. 3,299,041. Other dye developers suitable for use in diffusion transfer color photographic processes as practiced in the present invention are described in U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,136,605; 3,135,606; 3,135,734; 3,141,772; 3,142,565; 3,173,906; 3,183,090; 3,246,985; 3,230,086; 3,309,199; 3,230,083; 3,239,339; 3,347,672; 3,347,673; 3,245,790; 3,230,082; etc.

Specific examples of the dye developers suitable for use in the diffusion transfer color photographic materials of this invention include:

4-[p-(β-hydroquinonylethyl)phenylazo]-3-(N-n-hexylcarbamoyl)-1-phenyl-5-pyrazolone, 2-[p-(β-hydroquinonylethyl)phenylazo]-4-isopropoxy-1-naphthol, 1,4-bis-[β-(hydroquinonyl-α-methyl)-ethylamino]-5,8-dihydroxyanthraquinone,

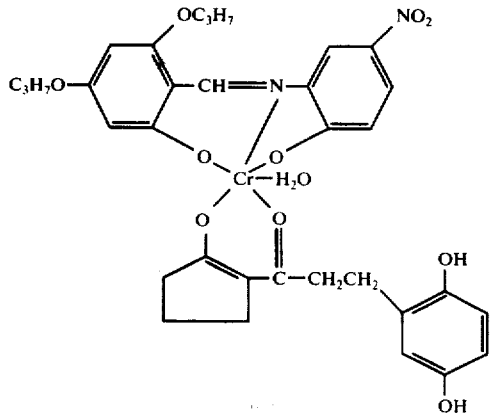

-continued

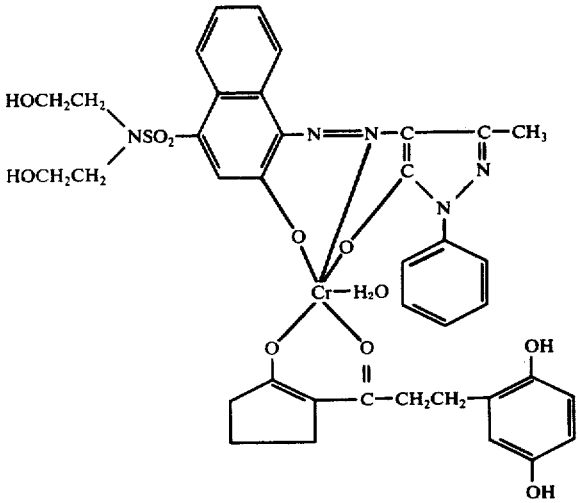

and

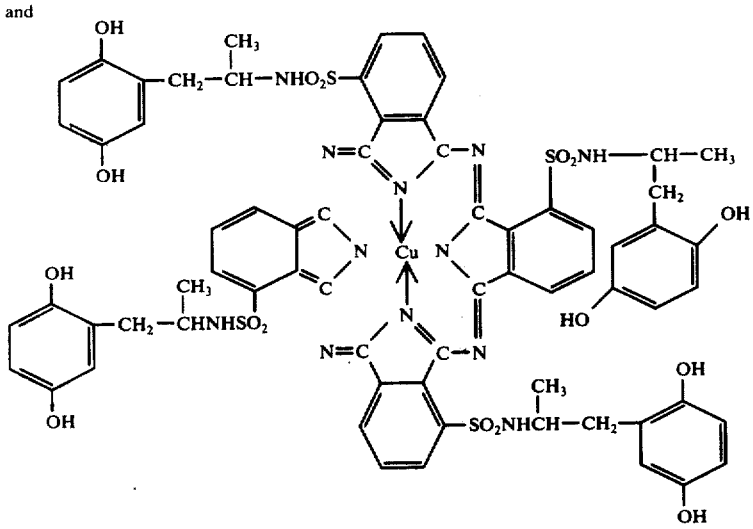

In the diffusion transfer color photographic process using a dye developer as the dye image-providing material, it is advantageous to use an auxiliary developing agent to accelerate the development. For this purpose, developing agents such as 1-phenyl-3-pyrazolidones as described in U.S. Pat. No. 3,039,869, hydroquinone derivatives such as 4'-methylphenylhydroquinone and 5-butylhydroquinone, or catechol derivatives as described in U.S. Pat. No. 3,617,277 may be incorporated in a liquid processing composition or in a light-sensitive element, in particular, in a silver halide emulsion layer, a dye developer-containing layer, an interlayer or in an uppermost protective layer. Furthermore, in order to accelerate the development and the diffusion transfer, the processing may be conducted in the presence of an onium compound such as N-benzyl-α-picolinium bromide as described in U.S. Pat. No. 3,173,786.

b. Diffusible dye-releasing couplers:

These are reactive, non-diffusing compounds capable of coupling with an oxidized developing agent, and, as a result of the coupling reaction, are capable of eliminating and releasing dyes which are soluble and diffusible in a developer composition. One type of diffusible dye-releasing coupler contains a structural moiety in which the coupling reaction site is substituted by a residue which is eliminated upon reaction with the oxidized developing agent. The electron conjugation system of the dye released may be either initially incorporated in the coupler or formed by the coupling reaction. The former is called a "preformed type". Couplers of this type show approximately the same spectral absorption as that of the dyes released. On the other hand, the latter type is called an "instantly formed type". Couplers of this type are colorless in principle, and, if colored, their absorptions have nothing directly to do with the absorptions of the dye released and are temporary.

Typical diffusible dye-releasing couplers are represented by the following general formulae;

(1) (Cp-1)-L-(Fr) ("pre-formed type"), and (2) (Cp-2)-L-(Bl) ("instantly formed type")

wherein Cp-1 represents a coupling reaction-active structure in which the coupling position is substituted by the (Fr)-L-moiety and at least one non-coupling position is substituted by a group containing a hydrophobic group having 8 or more carbon atoms which imparts a ballasting property to the coupler molecule, Cp-2represents a coupling reaction-active structure in which the coupling position is substituted by the (Bl)-L-moiety, and, when the coupler is to be used in combination with a developing agent having no water-solubilizing group, the Cp-2 group has a water-solubilizing group in at least one non-coupling position, and (Fe)-L- and (B*l*)-L- represent groups which are to be eliminated with an oxidized developing agent wherein Fr represents a dye structure moiety having an absorption in the visible wave length region and having at least one water-solubilizing group, and B*l* represents a group containing a hydrophobic group having 8 or more carbon atoms and imparting a ballasting property to the coupler molecule.

As the coupling reaction-reactive structure moiety utilized as Cp-1 and Cp-2, there are many functional groups which are known to undergo an oxidative coupling reaction with an aromatic primary amino color developing agent. For example, there are phenols, anilines, cyclic or open-chain active methylene compounds, and hydrazones. Specific examples of particularly useful reactive structure moieties include those derived from acylamino-substituted phenol, 1-hydroxy-2-naphthoic acid amide, N,N-dialkylaniline, 1-aryl-5-pyrazolone (where the 3-position is substituted by an alkyl group, an aryl group, an alkoxy group, an aryloxy group, an amino group, an acylamino group, an ureido group, a sulfonamido group, etc.), pyrazolobenzimidazole, pyrazolotriazole, α-cyanoacetophenone and α-acylacetanilide.

As the connecting or linkage group L whose bond to the coupler structure moiety is split by an oxidized developing agent, there can be illustrated an azo group, an azoxy group, a mercuryl group (—Hg—), an oxy group, a thio group, a dithio group, a triazolyl group, a diacylamino group, an acylsulfonamino group

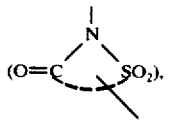

an acyloxy group, a sulfonyloxy group and an alkylidene group. Of these, an oxy group, a thio group, a dithio group, a diacylamino group, an acyloxy group, etc., which are to be eliminated as anions, are most useful since the amount of the diffusible dyes to be released is great. The coupling position of the coupling structure moiety of a phenol or naphthol is preferably substituted by the group to be bonded therewith through an oxy group, a thio group or a diacyloxy group. Also, the coupling position of a pyrazolone is preferably substituted by an azo group, a thio group or an acyloxy group, and the coupling position of an acylacetanilide by an oxy group, a thio group or a diacylamino group.

As typical examples of the dye structure moiety of Fr, there can be illustrated residues derived from azo dyes, azomethine dyes, indoaniline dyes, indophenol dyes, anthraquinone dyes, nitro dyes, azine dyes, etc.

The hydrophobic residues contained in the residues represented by Cp-1 and B*l* impart a cohesive force between coupler molecules in an aqueous medium and make the molecules non-diffusible in a hydrophilic colloid constituting a light-sensitive material. As the hydrophobic residues, there are advantageously used a substituted or unsubstituted alkyl group, an alkenyl group, an aralkyl group and an alkylaryl group, each having 8 or more carbon atoms. For example, there are a lauryl group, a stearyl group, an oleyl group, a 3-n-pentadecyl-phenyl group, a 2,4-di-t-amylphenoxy group, and the like. These hydrophobic residues are connected, directly or through a divalent bond such as an amido bond, an ureido bond, an ether bond, an ester bond or a sulfonamido bond, to the coupling fundamental structure moiety to form Cp-1. Also, these hydrophobic groups may themselves form B*l* or may be connected, directly or through the divalent bond as described above, to a residue such as an aryl group or a heterocyclic group to form B*l*. The water-solubilizing group contained in the residue represented by Cp-2 or Fr is an acidic group capable of being substantially dissociated in a processing composition or a precursor thereof which provides such an acidic group upon hydrolysis. In particular, acidic groups of a pKa of not more than 11 are useful. As such groups, there are a sulfo group, a sulfuric ester group (—O—$SO_3H$), a carboxy group, a sulfonamido group, a diacylamino group, a cyanosulfonamino group, a phenolic hydroxy group, etc.

The diffusible dye-releasing couplers represented by general formula (1) undergo, upon reaction with an oxidized developing agent, cleavage of bond L to provide a non-diffusible condensation product between Cp-1 and the developing agent, and a soluble dye having the Fr structure moiety. The resulting soluble dye diffuses into an image-receiving layer to form a dye image there.

The diffusible dye-releasing couplers represented by the general formula (2) undergo, upon reaction with an oxidized developing agent, cleavage of bond L to provide a soluble dye, which is an oxidative coupling reaction product between Cp-2 and the developing agent, and a non-diffusible, eliminated product derived from Bl-L-. The resulting soluble dye diffuses into an image-receiving layer to form a dye image there.

Examples of the diffusible dye-releasing couplers represented by structural formula (1) are as follows: α-[4-(8-acetamido-3,6-disulfo-1-hydroxy-2-naphthylazo)-phenoxy]-α-pivalyl-4-(N-methyl-N-octadecylsulfamyl)acetanilide disodium salt, 1-(p-t-butylphenoxyphenyl)-3-[α-(4-t-butylphenoxy)propionamido]-4-(2-bromo-4-methylamino-5-sulfo-1-anthra-9,10-quinalylazo)-5-pyrazolone, 1-hydroxy-4-[3-(4-N-ethyl-N-β-sulfoethylamino-2-methyl-phenylazo)phenylazo]-N-[8-(2,4-di-t-amylphenoxy)butyl]-2-naphthamide sodium salt.

Specific examples of the diffusible dye-releasing couplers of the type represented by structural formula (2) are as follows: α-(4-methoxybenzoyl)-α-(3-octadecylcarbamylphenyl-thio)-3,5-dicarboxyacetanilide, 1-phenyl-3-(3,5-dicarboxyanilino)-4-(3-octadecylcarbamylphenylthio)-5-pyrazolone, 1-phenyl-3-(3,5-disulfobenzoylamino)-5-(2-hydroxy-4-n-pentadecylphenylazo)-5-pyrazolone, 1-[4-(3,5-dicarboxylbenzamido)phenyl]-3-ethoxy-4-(3-octadecylcarbamylthio)-5-pyrazolone, 1-hydroxy-4-(3-octadecylcarbamylphenylthio)-N-ethyl-3',5'-dicarboxy-2-naphthanilide, 1-hydroxy-4-(n-octadecylsuccinimido)-N-ethyl-3',5'-dicarboxy-2-naphthanilide.

Other specific examples of useful diffusible dye-releasing couplers and the synthesis thereof are described in British Pat. Nos. 840,731, 904,364, 1,085,631, and in U.S. Pat. Nos. 3,476,563, 3,227,551, 3,644,498 and 3,419,391.

In the second type of diffusible dye-releasing couplers, the dye residue contained in the substitutent in the position adjacent to the coupling reaction position is split and released upon intramolecular ring-closing reaction with the substituent, which occurs subsequent to the condensation reaction with the oxidized developing agent. In particular, reactions in which an aromatic primary amino developing agent is oxidatively coupled to the 4-position of phenol or aniline and then forms an azine ring together with a sulfonamido group in the 3-position containing the dye structure moiety to release diffusible dyes having a sulfonic acid group, are useful.

Specific examples of this type of compound include: 1-phenyl-3-ethylcarbamoyl-4{2-methoxy-4-[N-n-dodecyl-N-(1-hydroxy-4-chloro-3-naphthyl)]sulfamylphenylazo}-5-pyrazolone, 2-(β-octadecylcarbamoylethyl)-4-{2-[4-(2-hydroxy-1-naphthylazo)phenylsulfonamido]-anilino}-phenol, and the like.

As the aromatic primary amino developing agents to be used in combination with the diffusible dye-releasing couplers, there are advantageously use p-aminophenol, p-phenylenediamine and derivatives thereof. In particular, 2-chloro-4-aminophenol, 2,6-dibromo-4-aminophenol, 4-amino-N,N-diethyl-3-methylaniline, N-N-diethyl-p-phenylenediamine, N-ethyl-β-methanesulfonamidoethyl-3-methyl-4-aminoaniline, 4-amino-N-ethyl-N-(δ-sulfobutyl)aniline, 4-amino-N-ethyl-N-(β-hydroxyethyl)aniline, 4-amino-3-methyl-N-ethyl-N-(β-hydroxylethyl)aniline, 4-amino-N-ethyl-N-(β-carboxyethyl)aniline, 4-amino-N,N-bis(β-hydroxyethyl)-3-methyl-aniline, 3-acetamido-4-amino-N,N-(β-hydroxyethyl)aniline, 4-amino-N-ethyl-N-(2,3-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline, and the salts of these anilines such as the hydrochloride, sulfate, oxalate, p-toluenesulfonate, etc. are useful. Furthermore, precursors of the developing agents, such as Schiff bases of these anilines and phthalimides are useful since they can be added to a light-sensitive element.

Negative type silver halide emulsion layers containing the diffusible dye-releasing coupler provide negative diffusion transfered dye images upon development processing. On the other hand, direct positive type silver halide emulsion layers containing the diffusible dye-releasing coupler provide positive diffusion transferred dye images. As direct positive emulsions, internal latent image type emulsions as are described in U.S. Pat. Nos. 2,592,250; 2,588,982; 3,227,552, etc., and fogged emulsions as are described in British Pat. Nos. 444,245; 462,730; U.S. Pat. Nos. 2,005,837; 2,541,472; 3,367,778, etc., are useful.

Positive diffusion transferred dye images can be obtained by processing a layer, which is provided adjacent the negative type silver halide emulsion layer and contains diffusible dye-releasing coupler and physical development nuclei, with a developer containing a solvent for silver halide. As techniques for forming several dye images utilizing physical development, those described in British Pat. No. 904,364 can be employed. Furthermore, light-sensitive elements containing, adjacent to a negative type silver halide emulsion layer containing a compound (DIR compound) which releases a development inhibitor such as 1-phenyl-5-mercaptotetrazole upon reaction with an oxidation product of a developing agent, a layer containing a diffusible dye-releasing coupler and a spontaneously reducible metal salt, provide positive diffusion transferred dye images as described in U.S. Pat. Nos. 3,227,551, 3,227,554 and 3,364,002, and German Patent OLS 2,032,711. In the present invention, a combination of these emulsions and the dye image-providing material can be employed, and suitable systems providing negative or positive dye images can be selected depending upon the purpose.

c. Diffusible dye-releasing, reducing agents

In the present invention, in addition to the aforesaid dye developers and diffusible dye-releasing couplers, there can advantageously be used dye image-providing materials which, after oxidation during development, release a diffusible dye upon intramolecular reaction or reaction with an auxiliary agent contained in the solution. In this type of dye image formation, it is advantageous to oxidize the dye image-providing material through an auxiliary developing agent such as hydroquinones, 3-pyrazolidones, etc. The oxidized dye image-providing material releases the diffusible dye by the action of a processing composition or of a supplementary agent such as a hydroxide ion, sulfite, ion, etc., present in a light-sensitive element. Specific examples of this type of dye image-forming agent are described in U.S. Pat. Nos. 3,585,026, 3,954,476 and 3,698,897 and in German Patent OLS 2,242,762.

The dye image-providing material used in the present invention can be dispersed in a carrier such as a hydrophilic colloid according to various methods, depending upon the type of dye image-providing material. For example, compounds such as diffusible dye-releasing couplers having a dissociative group such as a sulfo group or a carboxy group can be added to a hydrophilic colloid solution after being dissolved in water or in a aqueous alkaline solution. With dye image-providing materials which are slightly soluble in an aqueous medium and readily soluble in an organic solvent, they are first dissolved in an organic solvent and then the resulting solution is added to a hydrophilic colloid solution, followed by stirring or the like to disperse them as fine particles. As suitable solvents, there are ethyl acetate, tetrahydrofuran, methyl ethyl ketone, cyclohexanone, β-butoxy-β-ethoxyethyl acetate, dimethylformamide, dimethylsulfoxide, 2-methoxyethanol, tri-n-butylphthalate, etc. Of these dispersion solvents, those which possess a comparatively low vapor pressure can be vaporized upon drying of the photographic layers, or can be vaporized according to the method described in U.S. Pat. Nos. 2,322,027 and 2,801,171 prior to coating. Of these dispersion solvents, those which are readily soluble in water can be removed by washing with water according to U.S. Pat. Nos. 2,949,360 and 3,396,027.

In order to stabilize the dispersion of the dye image-providing material and accelerate the dye image-forming step, it is advantageous to incorporate, in a light-sensitive sheet, a solvent which is substantially insoluble in water and which has a boiling point of not less than 200° C at ordinary pressure together with the dye image-providing material. As high boiling point solvents suitable for this purpose, there are fatty acid esters such as triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyllaurylamide; hydroxy compounds such as 2,4-di-n-amylphenol; and the like. Furthermore, in order to stabilize the dispersion of dye image-providing material and to accelerate the step of dye image formation, it is advantageous to incorporate in a light-sensitive sheet a polymer having afinity for the solvent together with the dye image-providing material. As polymers having affinity for the solvent and suitable for this purpose, there are shellac, phenol-formaldehyde condensates, poly-n-butyl acrylates, n-butyl acrylate/acrylic acid copolymers, n-butyl acrylate/styrene/methacrylamide copolymers, and the like. These polymers may be dissolved in an organic solution, such as the above disclosed high boiling point solvents, together with the dye image-providing material and then dispersed in a hydrophilic colloid, or may be added, as a hydrosol prepared by emulsion polymerization or the like, to a hydrophilic colloid dispersion of the dye image-providing material.

In general, the dispersion of the dye image-providing material is efficiently conducted under a high shearing force. For example, a high speed rotary mixer, a colloid mill, a high pressure milk homogenizer, a high pressure homogenizer as described in British Pat. No. 1,304,206, an ultrasonic emulsifying apparatus, and the like are useful. The use of a surface active agent as an emulsifying aid markedly served to disperse the dye image-providing material. As the surface active agents useful for the dispersion of the dye image-providing material to be used in the present invention, there are sodium triisopropyl naphthalene-sulfonate, sodium dinonylnaphthalenesulfonate, sodium p-dodecylbenzenesulfonate, dioctyl sulfosuccinate sodium salt, sodium cetylsulfate and the anionic surface active agents as described in Japanese Patent Publication 4,293/64. The combined use of these anionic surface active agents and higher fatty acid esters of anhydrohexitol shows a particularly good emulsifying ability as is described in U.S. Pat. No. 3,676,141.

The silver halide emulsion used in the present invention is a colloidal dispersion of silver chloride, silver bromide, silver chlorobromide, silver bromoiodide, silver chlorobromoiodide or a mixture thereof. The halide composition is selected depending upon the end use purpose of the light-sensitive material and the processing conditions. In particular, a silver bromoiodide emulsion or silver chlorobromoiodide emulsion containing 1 mol % to 10 mol % iodide, not more than 30 mol % chloride and balance bromide is desirable. Useful silver halide grains are of a mean grain size of about 0.1 $\mu$ to about 2 $\mu$. In some end use purposes of the light-sensitive material, silver halides having a uniform grain size are preferable. The grains can be in a cubic form, an octahedral form or in a mixed crystal form. These silver halide emulsions can be prepared according to known conventional processes as are described in P. Glafkides; *Chimie Photographique* (2nd. ed., 1957, Paul Montel, Paris), Chapters 18 to 23. That is, a soluble silver salt such as silver nitrate and a water-soluble halide such as potassium bromide are reacted with each other in the presence of a solution of a protective colloid such as gelatin and crystals are allowed to develop in the presence of excess halide or a solvent for silver halide such as ammonia. For this process, there can be employed as the flocculation method a single or double jet method or a pAg-controlled double jet method. Removal of the soluble salts from the emulsion can be effected by washing and dialysis of the cool-set emulsion, by the combination of the addition of a flocculating agent such as an anionic polymer having sulfo groups, sulfuric ester groups or carboxy groups or an anionic surface active agent and adjustment of the pH, or by the combination of the use of an acylated protein such as phthaloyl-gelatin as a protective colloid and the adjustment of pH, to thereby cause flocculation.

The silver halide emulsions to be used in the present invention are preferably subjected to chemical sensitization by heat-treatment using a natural sensitizer contained in gelatin, a sulfur sensitizer such as sodium thiosulfate of N,N,N'-tri-methylthiourea, a gold sensitizer such as a thiocyanate complex salt or a thiosulfate complex salt of monovalent gold, or a reducing sensitizer such as stannous chloride or hexamethylenetetramine. Also, emulsions which are liable to form a latent image on the surface of the silver halide grains, and emulsions which are liable to form a latent image inside the silver halide grains as described in U.S. Pat. Nos. 2,592,550; 3,206,313, etc., can be used in the present invention.

The silver halide emulsions used in the present invention may be stabilized with additives such as 4-hydroxy-6-methyl-1,3,3*a*,7-tetrazaindene, 5-nitroimidazole, 1-phenyl-5-mercaptotetrazole, 8-chloromercuriquinoline, benzenesulfinic acid, pyrocatechin, etc. In addition, inorganic compounds such as cadmium salts, mercury salts, complex salts of platinum group metals such as a chloro complex salt of palladium, and the like are also useful for stabilizing the light-sensitive material of the present invention. Furthermore, the silver halide emulsions used in the present invention may contain sensitizing compounds such as a polyethylene oxide compound.

The silver halide emulsions used in the present invention can possess, if desired, color sensitivity expanded with optical sensitizing dyes. As useful optical sensitizing agents, there are cyanines, merocyanines, holopolar cyanines, styryls, hemicyanines, oxanols, hemioxanols, and the like. Specific examples of optical sensitizing agents are described in the aforesaid book by P. Glafkides, Chapters 35 to 41, and F. M. Hamer; "The Cyanine Dyes and Related Compounds" (Interscience). In particular, cyanines in which a nuclear nitrogen atom is substituted by an aliphatic group having a hydroxy group, a carboxy group or a sulfo group, e.g., those described in U.S. Pat. No. 2,503,776; 3,459,553 and 3,177,210, are especially useful for the practice of the present invention.

The processing solution permeable layer used in this invention such as the silver halide emulsion layer, the dye image-providing material-containing layer and the auxiliary layers (e.g., a protective layer, an interlayer, etc.) contain a hydrophilic polymer as a binder. As suitable hydrophilic polymers, there are gelatin, casein, gelatin modified with an acylating agent or the like, vinyl polymer grafted gelatin, proteins such as albumin, cellulose derivatives such as hydroxyethyl cellulose, methyl cellulose, carboxymethyl cellulose, etc., polyvinyl alcohol, partially hydrolyzed polyvinyl acetate, polyvinyl pyrrolidone, high molecular weight non-electrolytes such as polyacrylamide, polyacrylic acid, partially hydrolyzed polyacrylamide, anionic synthetic polymers such as vinyl methyl ether-maleic acid copolymers, N-vinylimidazole/acrylic acid/acrylamide copolymers, synthetic polymeric amphoteric electrolytes such as polyacrylamide subjected to the Hoffman reaction, and the like. These hydrophilic polymers can be used alone or as combinations thereof. Furthermore, these hydrophilic polymer layers may contain a latex-like polymer dispersion of hydrophobic monomers such as an alkyl acrylate, alkyl methacrylate, etc. These hydrophilic polymers, particularly polymers having functional groups such as an amino group, hydroxy group or carboxy group can be rendered insoluble with various cross-linking agents without loss of processing solution permeability. Paricularly useful cross-linking agents include aldehyde compounds such as formaldehyde, glyoxal, glutaraldehyde, mucochloric acid, acrolein oligomers, etc.; aziridine compounds such as triethylenephosphamide as described in Japanese Patent Publication 8790/62; epoxy compounds such as 1,4-bis(2',3'-epoxypropoxy)-diethyl ether as described in Japanese Patent Publication 7133/59; active halogen compounds such as 2-hydroxy-4,6-dichloro-s-triazine sodium salt as described in U.S. Pat. No. 3,325,287; active olefin compounds such as hexahydro-1,3,5-triacryl-s-triazine; methylol compounds such as N-polymethylol urea, hexamethylol melamine, etc.; high molecular weight compounds such as dialdehyde starch or 3-hydroxy5-chloro-s-triazinyl gelatin as described in U.S. Pat. No. 3,352,827, etc. These hydrophilic polymer layers can contain a cross-linking accelerating agent such as a carbonate or resorcin, as well as the cross-linking agent, if desired.

The photographic layers used in the present invention can be coated according to various coating methods such as dip coating roller coating, air knife coating, bead coating as described in U.S. Pat. No. 2,681,294 and curtain coating as described in U.S. Pat. Nos. 3,508,947 and 3,513,017. In particular, with light-sensitive elements of multi-layered structure, it is convenient to coat multiple layers at the same time using a multi-slit hopper as described in U.S. Pat. Nos. 2,761,417; 2,761,418; 2,761,419 and 2,761,791.

In order to facilitate the coating of the photographic layers used in the present invention, the coating composition cn advantageously contain any of a variety of surface active agents as a coating aid. As useful coating aids, there are illustrated nonionic surface agents such as saponin, p-nonylphenol-ethoxyethylene adducts, alkyl ethers of sugar, glycerin monoalkyl ethers, etc., anionic surface active agents such as sodium dodecylsulfate, sodium p-dodecylbenzenesulfonate, dioctylsulfosuccinate sodium salt, etc.; and amphoteric surface active agents such as carboxymethyldimethyllaur-vlammonium hydroxide inner salt, "Deriphat 151", betaine compounds as described in U.S. Pat. No. 3,441,413, British Pat. No. 1,159,825 and Japanese Patent Publication 21985/71.

In order to facilitate coating the photographic layers used in the present invention, the coating composition may contain various thickening agents. For example, in addition to those which increase the viscosity of the coating composition by their own viscosity such as high molecular weight polyacrylamides, anionic polymers such as cellulose sulfate, poly-p-sulfostyrene potassium salt and acrylic polymers as described in U.S. Pat. No. 3,655,407, which show a thickening action due to their mutual relationship with a binder polymer contained in the coating composition, are similarly useful.

In the light-sensitive element used in the present invention, a dye image-providing material is associated with a silver halide emulsion. The combination of the color sensitivity of the silver halide emulsion and the spectral absorption of the dye image is properly selected depending upon the intended color reproduction. In the reproduction of natural colors according to subtractive color photography, a light-sensitive element having at least two combinations of emulsions having selective spectral sensitivity in certain wave-length regions with compounds capable of providing images having selective spectral absorption in the same wavelength regions is used. In particular, a light-sensitive element having a combination of a blue-sensitive silver halide emulsion with a compound capable of providing a yellow dye image, a combination of a green-sensitive emulsion with a compound capable of providing a magenta dye image, and a combination of a red-sensitive emulsion with a compound capable of providing a cyan dye image is useful. In the light-sensitive element, these combination units of emulsions and dye image-providing materials are coated as layers in face to face alignment or coated by forming each into particles and mixing. In a preferred multilayered structure, there are positioned, in sequence from the side to be exposed, a blue-sensitive emulsion layer, a green-sensitive emulsion layer and a red-sensitive emulsion layer. In particular, in the case of high speed emulsions containing iodide, a yellow filter layer may be positioned intermediate the blue-sensitive emulsion and the green-sensitive emulsion. This yellow filter layer contains a yellow colloidal silver dispersion, an oil-soluble yellow dye dispersion, an acidic dye mordanted with a basic polymer, or a basic dye mordanted with an acidic polymer. The emulsion layers are advantageously spaced from each other by an interlayer. The interlayer prevents unfavorable mutual reactions occurring between emulsion layer units having different color sensitivities. The interlayer typically comprises a polymer containing fine pores formed from a latex of a hydrophilic polymer and hydrophobic polymer, as described in U.S. Pat. No. 3,625,685 or a polymer whose hydrophilicity is to be gradually increased by the processing composition, such as calcium alginate as described in U.S. Pat. No. 3,384,483, as well as a hydrophilic polymer such as gelatin, polyacrylamide, partially hydrolyzed products of polyvinyl acetate, etc.

The interlayer may contain an interlayer mutual action-controlling agent selected depending upon the type of the dye image-providing material and the processing composition used. For example, with a dye image-providing material of the type which releases a diffusible dye by reaction of the oxidation product of a developing agent, reducing agents such as ballasted hydroquinone derivatives and ballasted couplers capable of reacting with an oxidation product to be fixed are effective to prevent unfavorable interchange of the oxidation product of a developing agent between emulsion layer units. Further, in conducting image reversal utilizing solution and physical development, the incorporation of physical development nuclei such as colloidal metallic silver, in addition to the above-described ingredients, in the interlayer is useful to obtain good color reproduction. Also, in conducting image reversion using a development inhibitor-releasing (DIR) compound, incorporation of a fine-grained silver halide of low sensitivity is useful to obtain good color reproduction.

The processing composition used in the present invention is a liquid composition containing the processing components necessary for the development of a silver halide emulsion and necessary for the formation of diffusion transferred dye image. The main solvent therein is water, but, in some cases, hydrophilic solvents such as methanol or methyl cellosolve are further present. The processing composition contains alkali in an amount sufficient to maintain the pH at a level necessary to causing development of the emulsion layer and to neutralize acids produced during various steps for development and dye image formation. As the alkali, there can be used sodium hydroxide, potassium hydroxide, a calcium hydroxide dispersion, tetramethylammonium hydroxide, sodium carbonate, trisodium phosphate, diethylamine, etc. The processing composition preferably possesses a pH of not less than about 12 at room temperature. More preferably, the processing composition contains a hydrophilic polymer such as high molecular weight polyvinyl alcohol, hydroxyethyl cellulose, sodium carboxymethyl cellulose or the like. These polymers impart to the processing composition a viscosity of not less than 1 poise, preferably about 1,000 poise, at a room temperature, which not only facilitate uniformly spreading the composition upon processing but also forms, upon concentration of the processing composition due to the migration of the aqueous solvent into the light-sensitive element and the image-receiving element in the course of the processing, an immovable film, thus serving to unify the film unit after processing. In addition, this polymer film serves, after the substantial completion of the formation of a diffusion transferred dye image, to control further migration of the coloring ingredients into the image-receiving layer, thereby preventing the image from being changed.

In some cases, the processing composition advantageously contains a light absorbent such as carbon black and a desensitizer as described in U.S. Pat. No. 3,579,333 to prevent the silver halide emulsion from being fogged by exterior light during processing. Furthermore, the processing composition advantageously contains processing ingredients specific to the dye image-providing material used. When dye developers are used as a dye image-providing material, auxiliary developing agents such as p-aminophenol, 4'-methylphenylhydroquinone, 1-phenyl-3-pyrazolidone, etc., an onium development accelerator such as N-benzyl-α-picolinium bromide and an anti fogging agent such as benzotriazole are examples of such ingredients, and, when diffusible dye-releasing couplers are used as an image-providing material, developing agents such as an aromatic primary amino color developing agent, an antioxidant such as a sulfite or ascorbic acid, an antifogging agent such as a halide or 5-nitro-benzimidazole, a silver halide solvent such as thiosulfate or uracil are examples of such ingredients.

When a transparent support such as a polyethylene terephthalate film, a cellulose triacetate film, etc., is used as a support for an image-receiving element, incorporation of a white reflecting agent such as titanium dioxide in a processing solution enables one to observe a positive image through the support without separating the image-receiving material and the negative material from each other after spreading a processing solution therebetween to conduct diffusion transfer processing. At this time, it is preferred to incorporate 20 to 60% by weight of the white reflecting agent in the processing solution, though such is not limitative.

When no white reflecting agent is used, positive images can be observed by separating the negative material and the image-receiving material from each other after exposure and transfer processing.

The processing composition used in the present invention is advantageously retained in a rupturable container. Such a container is advantageously prepared by folding a sheet of a liquid- and air-impervious substance and sealing each edge to form a cavity in which the processing composition is to be retained, and the container is advantageously formed so that when the film unit is passed through pressure-applying members it is ruptured at a given portion due to the inner hydraulic pressure generated within the processing composition to thereby release the contents. As substances for forming the container, there are advantageously used a polyethylene terephthalate/polyvinyl alcohol/polyethylene laminate, a lead foil/vinyl chloride-vinyl acetate copolymer laminate or the like. This container is desirably fixedly positioned and extends transverse a leading edge of the film unit to effect a substantially unidirectional discharge of the container's contents on the surface of the light-sensitive element. Preferred examples of such container are described in U.S. Pat. Nos. 2,543,181; 2,643,886; 2,653,732; 2,723,051; 3,056,491; 3,056,492; 3,152,515; 3,173,580, etc.

Various polymer mordants can be used for the image-receiving layer. For example, there may be used generally known basic polymers and cationic polymers (for example, those as described in Japanese Patent Publication 26135/63). In particular, polymer mordants having the following structure are preferred, but such are not to be construed as limitative.

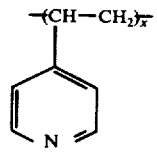
1.

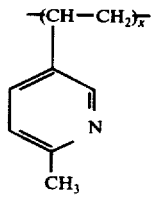
2.

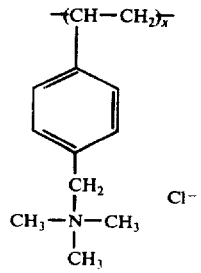
3.

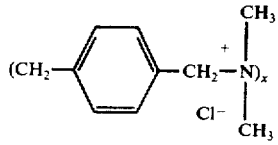
4.

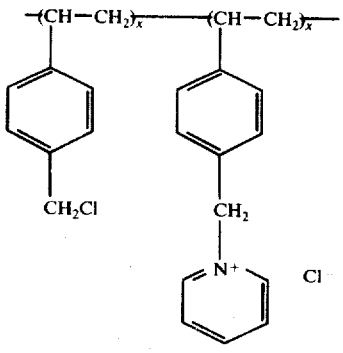
5.

-continued

6.

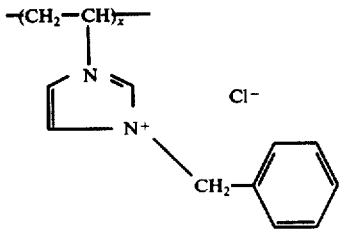

7.

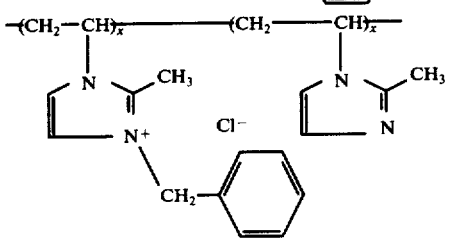

8.

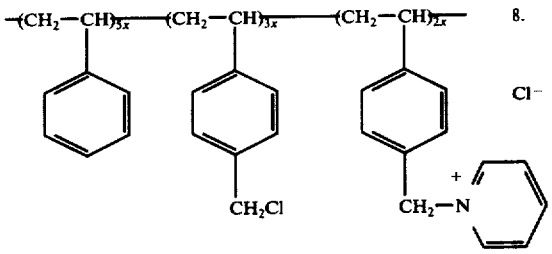

9.

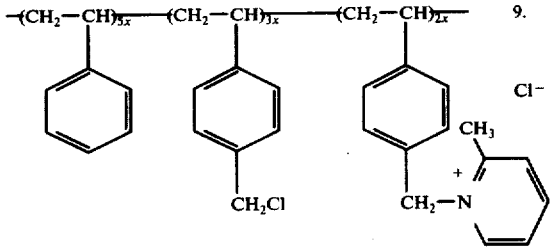

10.

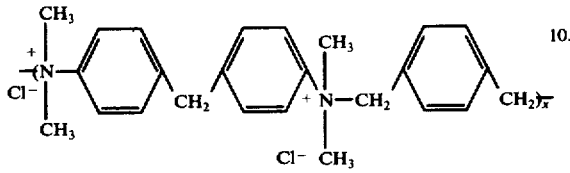

11.

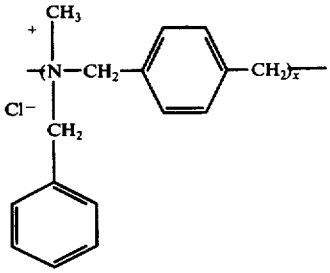

(In the above formulae, X represents the polymerization degree, and X is in the range of from about $10^2$ to about $5 \times 10^3$, preferably from $5 \times 10^2$ to $2 \times 10^3$.)

The polymer mordants for the image-receiving layer may be used by forming an independent film or they may be used in combination with a different natural or synthetic polymer such as gelatin, polyvinyl alcohol, polyvinyl pyrrolidone, etc. Also, two different polymer mordants may be used in combination. The thickness of the image-receiving layer may be varied depending upon the end use, but, preferably, it is in the range of about 3 to about 60 μ, particularly preferably 5 to 20 μ, which however, is not to be construed as limitative at all.

As the support, any ordinarily used for photographic use can be used. For example, there are a baryta paper, a paper laminated with resin such as polyethylene, a sheet of a cellulose organic acid ester such as cellulose diacetate, cellulose triacetate, cellulose acetate butyrate, etc., a sheet of an inorganic acid ester such as cellulose nitrate, a sheet of an organic polymer such as polyethylene terephthalate, polyvinyl acetate, etc., a sheet of polyvinyl acetals such as polyvinyl acetal, a sheet of polyalkylenes such as polystyrene, polypropylene, polyethylene, etc., and the like.

The present invention will now be illustrated in more detail by the following preferred examples of the present invention. Unless otherwise indicated, in the following Examples all percentages are weight percentages.

EXAMPLE 1

Onto a gelatin-subbed polyethylene terephthalate support were coated, in sequence, an acidic polymer layer and a timing layer as follows to prepare a material (to be called "Film A"). Also, on the same type of polyethylene terephthalate support was coated gelatin in a thickness of 10 μ to prepare another material (to be called "Film B"). After superposing Film A and Film B over one another with the coated surfaces facing each other, an alkaline processing solution was spread therebetween in a liquid thickness of 100 μ. After a definite period of time as shown in Table 2, Films A and B were delaminated from each other, and the pH at the surface of Film B was measured using a small electrode for use in measuring pH. The results are shown in Table 2.

Coating of acidic polymer layer

Onto the polyethylene terephthalate support as described above was uniformly coated a polyacrylic acid solution having the following composition in a proportion of 150 g/m², and then dried in a 100° C air bath.

| | | |
|---|---|---|
| 20% Aqueous Solution of Polyacrylic Acid | 6 | Kg |
| 5% Aqueous Solution of Sodium Dodecylbenzenesulfonate | 150 | ml |
| Polyethylene Glycol (mean molecular weight: 400) | 50 | g |
| Water | 3.75 | liter |
| (viscosity at 20° C: about 2000 cp) | | |

Coating of timing layer

Onto the acidic polymer layer was coated a timing layer as shown in the following Table 1.

Table 1

| Sample No. | Polymer used for Timing Layer | Solvent for Coating | Dry Thickness |
|---|---|---|---|
| A-1 (Present Invention) | Poly(2-acetoxyethyl methacrylate) | Ethyl Acetate | 0.8 μ |
| A-2 | Poly(2-acetoxyethyl acrylate) | " | 1.1 μ |

Table 1-continued

| Sample No. | Polymer used for Timing Layer | Solvent for Coating | Dry Thickness |
|---|---|---|---|
| (Present Invention) | | | |
| A-3 (Present Invention | 2-Hydroxyethyl acrylate/2-acetoxyethyl methacrylate Copolymer (molar ratio = 1:9) | " | 0.9 μ |
| A-4 (Present Invention) | 2-Hydroxyethyl acrylate/2-acetoxyethyl methacrylate Copolymer (molar ratio = 3:7) | " | 1.2 μ |
| A-5 (Present Invention) | 2-Hydroxyethyl acrylate/2-acetoxypropyl acrylate Copolymer (molar ratio = 3:7) | " | 1.1 μ |
| A-6 Comparison) | Polyvinyl alcohol (polymer described in U.S. Pat. No. 3,362,819) | Water | 10 μ |

All of the above polymers had an intrinsic viscosity of 1.0 ± 0.3 in methanol.

Preparation of processing composition

An alkaline processing of the following prescription was used.

| | |
|---|---|
| Ascorbic Acid | 0.2 g |
| 3-Methyl-4-amino-N-ethyl-N-(β-hydroxyethyl)aniline Sulfate | 30.0 g |
| Potassium Bromide | 1.4 g |
| Sodium Hydroxide | 35 g |
| Hydroxyethyl Cellulose | 30 g |
| Water to make | 1 Kg |
| (viscosity: 5000 poise at 20 ° C) | |

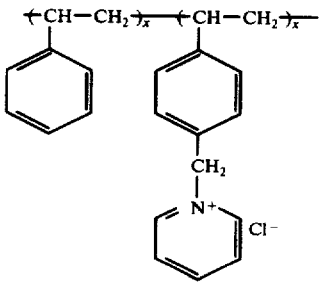

(x: 50 mol %; molecular weight: 50,000)

Table 2

| Film A No. | Change in surface pH of Film B with the passage of time | | | | | | | |
|---|---|---|---|---|---|---|---|---|
| | After 1 min | After 5 min | After 10 min | After 15 min | After 20 min | After 30 min | After 45 min | After 60 min |
| A-1 (Present Invention | 12.5 | 12.4 | 12.4 | 12.3 | 8.6 | 7.1 | 6.5 | 6.5 |
| A-2 (") | 12.7 | 12.5 | 12.4 | 11.8 | 9.0 | 7.5 | 7.0 | 6.5 |
| A-3 (") | 12.3 | 12.3 | 12.4 | 12.1 | 8.2 | 7.0 | 6.3 | 6.3 |
| A-4 (") | 12.6 | 12.5 | 12.5 | 12.2 | 12.1 | 9.0 | 8.0 | 7.0 |
| A-5 (") | 12.5 | 12.4 | 12.4 | 9.1 | 8.0 | 7.0 | 6.5 | 6.5 |
| A-6 (Comparison) | 12.6 | 10.9 | 8.5 | 6.6 | 6.4 | 5.7 | 5.4 | 5.4 |

As is clear from the comparative experiment data, when the timing layer of the present invention is used the pH is maintained at a level as high as about 12 to 13 until 10 to 20 minutes after development, and, thereafter, the pH rapidly decreased, which is an ideal pattern. On the other hand, when the comparative timing layer was used, the pH was found to rapidly decrease after development.

EXAMPLE 2

Onto a 100 μ-thick polyethylene terephthalate support were coated, in sequence, an image-receiving layer, a white reflecting layer, a diffusible dye-providing layer, an interlayer, a blue-sensitive emulsion layer and a protective layer as described below to prepare a light-sensitive material.

Image-receiving layer:

A layer containing the polymer mordant having the following structure and gelatin in a proportion (by weight) of 1:3 (thickness: 7 μ).

2. White reflecting layer:

Gelatin containing titanium dioxide and gelatin in a proportion (by weight) of 5:1 (thickness: 10 μ).

3. Diffusible yellow dye-providing layer:

100 g of a silver bromoiodide emulsion containing 5.7 mol% iodide (silver content: 42.0 mmol; numerical average of grain size of silver halide dispersion: 0.81 μ; standard deviation of grain size distribution of the dispersion approximated by logarithmic normal distribution: 0.34 μ) was taken up, and 2.5 ml of a methyl alcohol solution containing $2 \times 10^{-6}$ mol of N,N,N'-triethylthiourea was added thereto, then the mixture heated at 75° C for 100 minutes while stirring to impart spontaneous developability thereto.

40 mg of a desensitizing agent having the following structure was dissolved in 10 ml of β-phenoxyethanol while heating, and the resulting solution added to 60 ml of an aqueous solution containing 0.3 g of sodium p-dodecylbenzenesulfonate and 6.0 g of gelatin, followed by vigorous stirring to disperse the system. 15 g of this dispersion was added to the above-described spontaneously developable emulsion, and the system stirred for 30 minutes.

Desensitizer

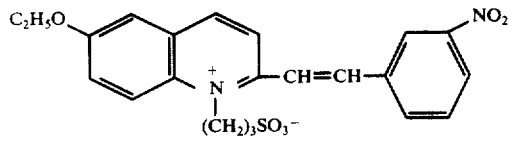

A hot solution consisting of 4.9 g of a diffusible yellow dye-forming coupler, i.e., α-pivaloyl-α-(4-octadecyloxycarbonylphenoxy)-3,5-decarboxyacetanilide, 0.4 g of 2,5-di-t-octylhydroquinone, 8 ml of N,N-diethyllaurylamide, 0.2 g of sorbitan monolauric acid ester and 10 ml of cyclohexanone was added to an aqueous solution containing 4 g of gelatin and 0.3 g of bis(2-ethylhexyl)-α-sulfosuccinate sodium salt, and the system vigorously stirred mechanically at 45° C for 15 minutes to finely emulsify the coupler. The thus obtained emulsion was added to the above-described emulsion and, after adding thereto 3 ml of an aqueous solution containing 0.15 g of 1-hydroxy-3,5-dichloro-s-triazine sodium salt, the system coated as a first layer in a dry thickness of 3.5 μ.

4. Interlayer:

A layer comprising 1.5 mg of 2,5-di-tert-octylhydroquinone, 3 mg of di-n-butyl phthalate and 13.5 mg of gelatin per 100 $cm^2$ was provided as a second layer.

5. Emulsion layer:

A hot solution consisting of 3.6 g of α-benzoyl-α-(1-phenyl-5-tetrazolythio)-aceto-2-methoxy-5-n-tetradecyloxycarbonylanilide, 1.0 g of a copolymer of vinyl acetate and N-vinyl pyrrolidone (3:7 molar ratio) (molecular weight: about 50,000), 5 ml of tri-o-cresyl phosphate and 5 ml of ethyl acetate was added to an aqueous solution containing 4 g of gelatin and 0.3 g of bis(2-ethylhexyl)-α-sulfosuccinate sodium salt, followed by vigorous mechanical stirring at 45° C for 15 minutes to finely emulsify the coupler.

To 100 g of a silver bromoiodide emulsion containing 6.0 mol% iodide (silver content: 62 mmol; numerical average of grain size of silver halide dispersion: 1.2 μ; standard deviation of grain size distribution of the dispersion approximated by logarithmic normal distribution: 0.43 μ) was added the above-described coupler emulsion and, after adding thereto 3 ml of an aqueous solution containing 0.15 g of 1-hydroxy-3,5-dichloro-s-triazine sodium salt, coated in a dry thickness of 2.5 μ.

6. Protective layer:

A gelatin layer of 1.0 μ in dry thickness.

Samples of the thus prepared light-sensitive materials were superposed, after image-wise exposure, on Films A-1, A-2, A-3, A-4, A-5 or A-6 having a neutralizing mechanism as shown in Example 1, with the protective layer (light-sensitive layer) and the timing layer facing each other. Then, a processing solution having the following composition was spread in a thickness of 100 μ therebetween to develop the emulsion layer, followed by diffusion transfer of dye images. Thus, images appearing on the surface of the image-receiving layer were observed.

When Films A-1, A-2, A-3, A-4 and A-5 were used, the developing velocity was remarkably rapid as compared with the case of using A-6. Also, the clearness of images was as good as that in the case of using A-6.

| Composition of the processing solution: | | |
|---|---|---|
| Ascorbic Acid | 0.2 | g |
| 3-Methyl-4-amino-N-ethyl-N-(β-hydroxyethyl)aniline Sulfate | 30.0 | g |
| Potassium Bromide | 1.4 | g |
| Trisodium Phosphate 12 Hydrate | 20.0 | g |
| Sodium Hydroxide | 40.0 | g |
| Hydroxyethyl Cellulose | 30.0 | g |
| Water | 880 | ml |
| (viscosity at 25° C: 30,000 cp) | | |

While the invention has been described in detail and with reference to specific embodiments thereof, it will be apparent to one skilled in the art that various changes and modifications can be made therein without departing from the spirit and scope thereof.

What is claimed is:

1. A material for a color diffusion transfer photographic process, which comprises a support and which possesses neutralizing means thereon comprising the combination of a timing layer containing a polymer having a repeating unit represented by the following general formula (I):

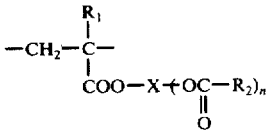

where $R_1$ represents a hydrogen atom or a methyl group, $R_2$ represents a hydrogen atom, an aliphatic hydrocarbon residue having 1 to 6 carbon atoms or an aryl group, and X represents an n+1 valent aliphatic hydrocarbon residue having 2 to 8 carbon atoms or an n+1 valent residue of the formula $\text{-}(A\text{-}O)_m\text{-}A$, wherein A represents an aliphatic hydrocarbon residue having 2 to 4 carbon atoms, and *m* and *n* each represents an integer of 1 to 5, and an acidic polymer layer between said support and said timing layer.

2. The material of claim 1, wherein said polymer is a homopolymer.

3. The material of claim 1, where in said polymer is a copolymer containing from about 10 to about 98 mol% of said repeating unit.

4. The material of claim 3, wherein said copolymer is a copolymer with a monomer selected from acrylic acid, acrylic acid esters, acrylamides, methacrylic acid, methacrylic acid esters, methacrylamides, allyl compounds, vinyl ethers, vinyl esters, vinyl heterocyclic compounds, styrenes, maleic acids, fumaric acids, itaconic acids, olefins and crotonic acids.

5. The material of claim 1 wherein said polymer has a molecular weight of about 2000 or more.

6. The material of claim 4 wherein said polymer has a molecular weight of from 100,000 to 1,000,000.

7. The material of claim 5 wherein said acidic polymer layer comprises an acidic polymer having a molecular weight of from about 10,000 to about 100,000.

8. The material of claim 7, wherein said acidic polymer layer has a thickness of from about 5 to about 30 μ.

9. The material of claim 8 wherein said timing layer containing said polymer having said repeating unit has a thickness of from about 0.5 to about 30 μ.

* * * * *